US005358349A

United States Patent [19]

Burroughs et al.

[11] Patent Number: 5,358,349

[45] Date of Patent: Oct. 25, 1994

[54] GLUE APPLICATOR

[75] Inventors: Andrew C. Burroughs, Kenosha, Wis.; Andrew B. Hodge, Evanston; Edward F. Sexton, Northbrook, both of Ill.

[73] Assignee: Revell-Monogram, Inc., Morton Grove, Ill.

[21] Appl. No.: 147,157

[22] Filed: Nov. 3, 1993

[51] Int. Cl.[5] ..... B43K 8/04; B43K 8/06

[52] U.S. Cl. ..... 401/184; 401/198; 401/199; 401/6

[58] Field of Search ..... 401/184, 186, 199, 198, 401/6; 15/435

[56] References Cited

U.S. PATENT DOCUMENTS

| | | | |
|---|---|---|---|
| 190,266 | 5/1877 | Berlie et al. | 401/184 X |
| 360,298 | 3/1887 | Hewitt | 15/435 |
| 3,468,611 | 9/1969 | Ward | 401/186 |
| 4,556,336 | 12/1985 | Sano et al. | 401/199 |
| 4,671,692 | 6/1987 | Inaba | 401/199 |
| 4,770,558 | 9/1988 | Frietsch | 401/199 |

FOREIGN PATENT DOCUMENTS

| | | | |
|---|---|---|---|
| 2072587 | 1/1981 | United Kingdom | 401/199 |

*Primary Examiner*—Steven A. Bratlie

*Attorney, Agent, or Firm*—Dressler, Goldsmith, Shore & Milnamow, Ltd.

[57] ABSTRACT

A glue applicator for storing and applying liquid glue. The applicator includes an elongated generally cylindrical body member, a rigid elongated inner core member positioned within the body member, a fibrous tip member, a liquid glue material contained within the body member, and a cap member for sealing the distal end of the body member. The body member includes a squeezable portion of generally elliptical transverse cross-section located adjacent a distal end portion thereof. The inner core member includes portions thereof that are in contact with an inner surface of the body member along the length thereof. The fibrous tip is received in an elongated cavity formed in a distal end portion of the inner core member. A plurality of openings formed through the inner core member permit the passage of liquid glue from the body member therethrough into the cavity so as to contact the fibrous tip member.

18 Claims, 4 Drawing Sheets

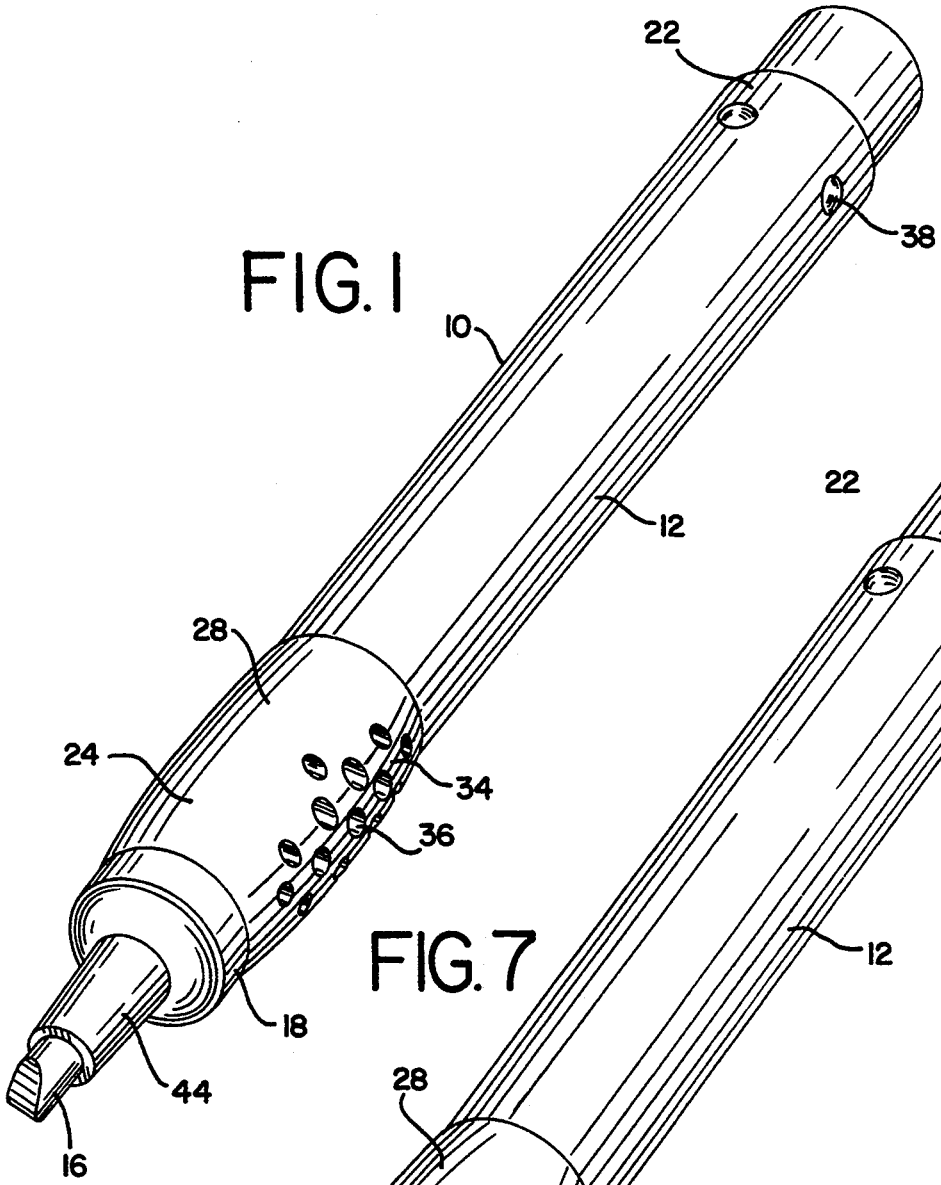
FIG. 1
FIG. 7
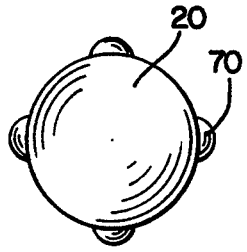
FIG. 8

11
12
42
48
47
50
14
47
48
50
54
56
44
11
12
16
20
70
64
60
18
62
26
24
30
32
28
12
22
38

GLUE APPLICATOR

FIELD OF THE INVENTION

The present invention is directed to a glue or solvent bonder applicator for storing and applying a liquid glue or solvent bonder material. More specifically, the invention is directed to a glue applicator device that is particularly useful during the assembly of polystyrene plastic model kits.

BACKGROUND OF THE INVENTION

There are numerous prior art devices for storing and applying glue or solvent bonder materials. Such devices typically include a flexible body or tube portion that is squeezed to force a liquid glue or bonder material contained therein through a nozzle having a relatively small opening. Such devices may include an internal valve to control the flow of materials that may be actuated by the application of a force thereto. There are also similar devices that have a substantially rigid body that rely on gravity to direct the liquid material through a distal opening. Such devices have been provided with brushes and fibrous tips to facilitate application of the liquid glue or bonder material.

There is a need for an improved glue applicator device for storing and applying a liquid glue or bonder material that provides constant glue or bonder availability at the delivery tip without the use of an internal valve. It is desirable that such a device be able to instantly make available extra glue or bonder material at the point of application. It is further desirable that the device have a delivery tip that remains constantly moist with glue or bonder material so that it is ready for use without having to be primed. It is also desirable that the device be ergonomically designed in order to facilitate the delivery of plastic model glue or bonder material to the model builder in a manner that ensures a clean and well-assembled model.

SUMMARY OF THE INVENTION

The present invention provides an ergonomically designed glue applicator for storing and applying a liquid glue or bonder solvent material. The glue applicator includes an elongated generally cylindrical body member, a rigid elongated inner core member positioned within the body member, a fibrous tip member, a liquid glue or bonder material contained within the body member, and a means for sealing the distal end of the body member.

The elongated body member has a closed proximal end portion and an open distal end portion. A squeezable portion, located adjacent the distal end portion, is of increased cross-sectional dimension and may be deflected inwardly by a force applied by a finger. The squeezable portion is generally elliptical in transverse cross-section. A first section of the squeezable portion is concave in longitudinal cross-section and may be provided with a plurality of spaced apart projections extending outwardly therefrom. A second section of the squeezable portion is concave in longitudinal cross-section and may be provided with a plurality of spaced apart cavities formed therein.

The inner core member is positioned within the body member and extends along substantially the entire length thereof. The inner core member comprises a pair of elongated, intersecting, perpendicular partition portions that are dimensioned to contact an inner surface of the body member. A plurality of longitudinally spaced apart rib portions project transversely from the longitudinal center of the body member toward an inner surface of the body member. The distal end portion of the inner core member is frusto-conical in shape and has an elongated cavity formed therein. A proximal end portion of the fibrous tip member is received within the cavity. A plurality of openings are formed in the inner core member so as to permit the passage of liquid glue from the body member therethrough into the cavity for contacting the fibrous tip member.

The means for sealing the distal end of the body member comprises a seal ring portion formed adjacent a distal end portion of the inner core member that is dimensioned to sealingly engage an inner surface of the body member. A ferrule member having a female portion of a snap fit assembly is received by a male portion of a snap fit assembly formed on an external surface of a distal end portion of the body member for urging the ring portion into sealing contact with the inner surface of the body member.

These and other aspects and attributes of the present invention will be discussed with reference to the following drawings and accompanying specification.

BRIEF DESCRIPTION OF THE DRAWINGS

FIG. 1 is a perspective view of a glue applicator constructed in accordance with the invention with the cap member removed;

FIG. 7 is a perspective view of the glue applicator shown in FIG. 1 with the cap member applied to the distal end thereof;

FIG. 8 is an end view of the cap member;

DESCRIPTION OF A PREFERRED EMBODIMENT

Figure 2:
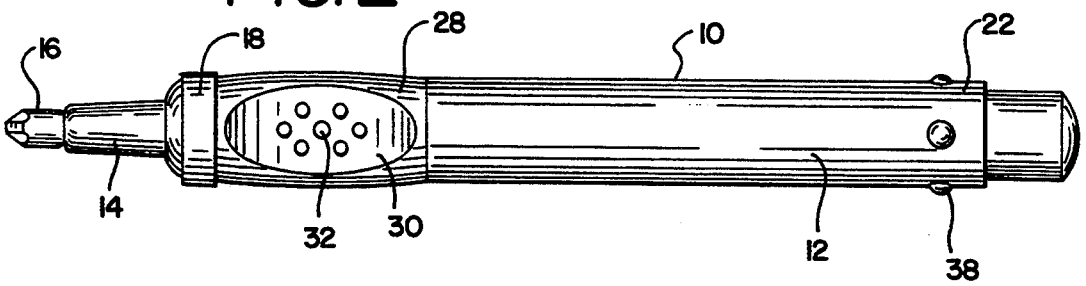
FIG. 2 is a top plan view of the glue applicator as shown in FIG. 1.

Referring to FIGS. 1–12, there is shown a glue applicator 10 constructed in accordance with the invention. Applicator 10 includes a body member 12, an inner core member 14, a fibrous tip member 16, a sealing ferrule member 18 and a protective cap member 20.

Body member 12 is an elongated, generally cylindrical member having a closed proximal end portion and a distal end portion 24. The distal end portion has a male portion 26 of a snap fit assembly formed integrally therewith.

Figure 3:
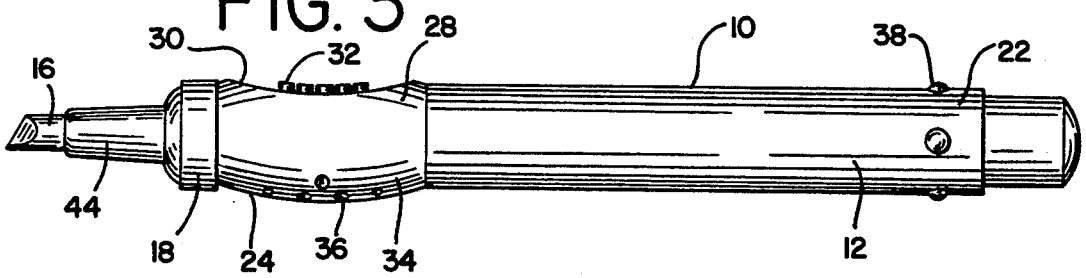
FIG. 3 is an elevational view of the glue applicator as shown in FIG. 1.
Figure 4:
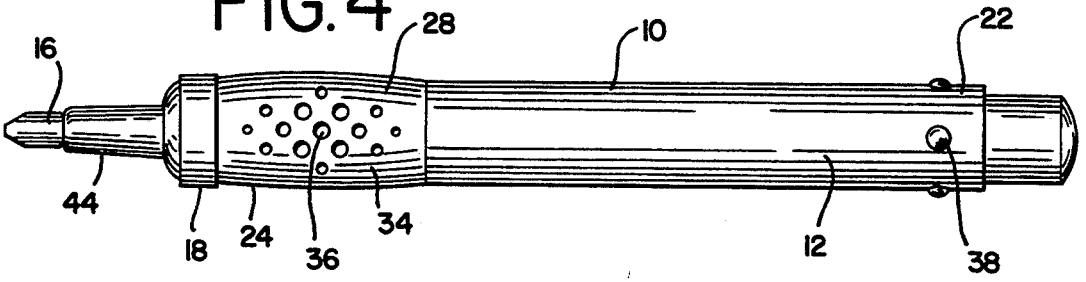
FIG. 4 is a bottom plan view of the glue applicator as shown in FIG. 1.
Figure 5:
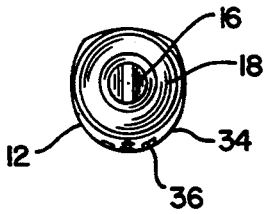
FIG. 5 is an end view of the proximal end of the glue applicator as shown in FIG. 1.
Figure 6:
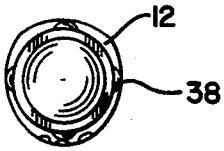
FIG. 6 is an end view of the distal end of the glue applicator as shown in FIG. 1.

A squeezable portion 28, of generally elliptical transverse cross-section, is located adjacent distal end portion 24. Squeezable portion 28 includes a first section 30 that is generally concave in longitudinal cross-section, as best seen in FIG. 3. Section 30 has a plurality of spaced apart projections 32 extending outwardly therefrom. Squeezable portion 28 also includes a section 34 that is generally convex in longitudinal cross-section, as best seen in FIG. 3. Section 34 has a plurality of spaced apart cavities 36 formed therein. The first section 30 is diametrically opposed to the second section 34.

Figure 10:
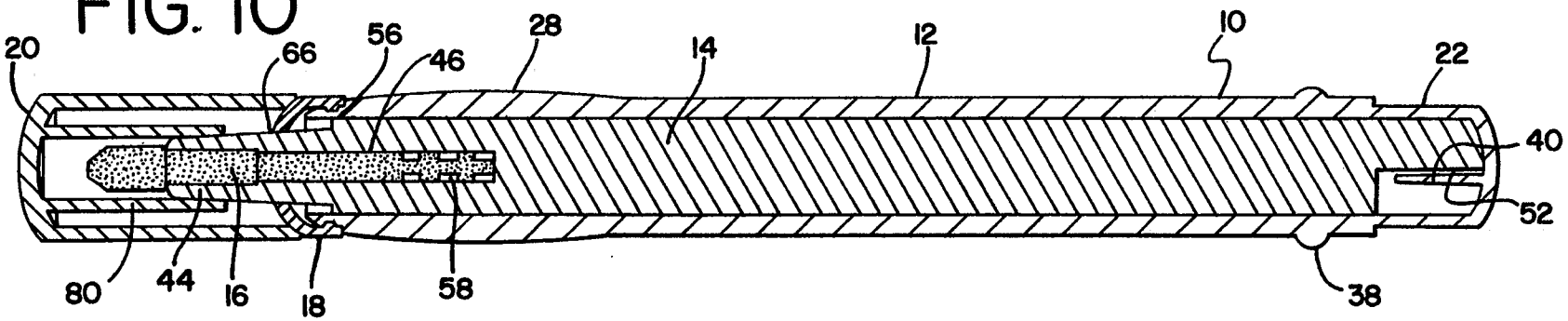
FIG. 10 is a cross-sectional view taken along line 10—10 in FIG. 7.
Figure 11:
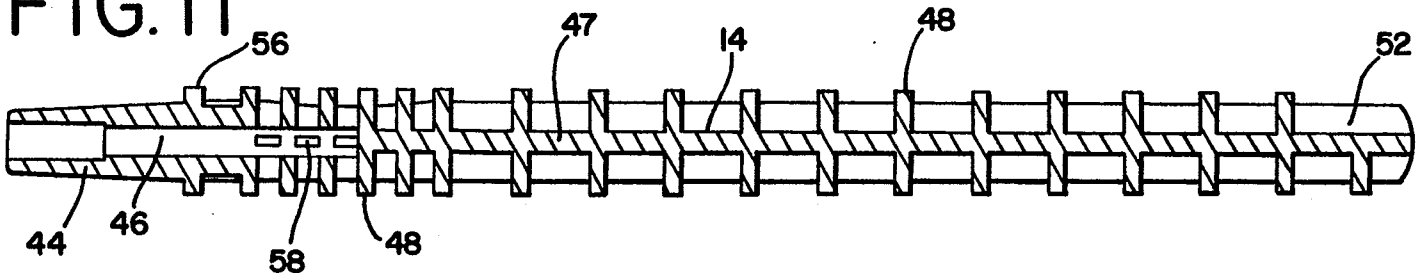
FIG. 11 is a cross-sectional view of the inner core member taken along line 11—11 in FIG. 9.
Figure 12:
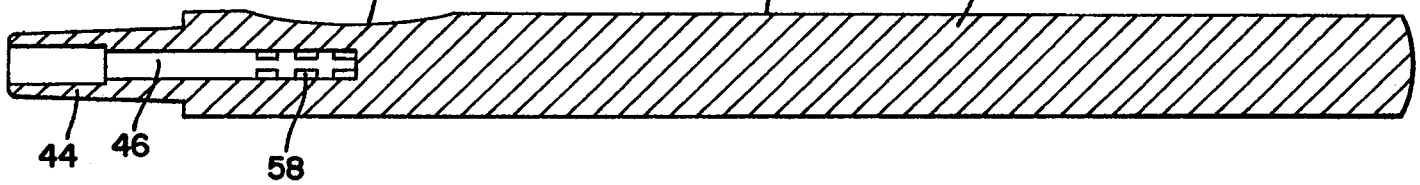
FIG. 12 is a cross-sectional view of the inner core member taken along line 12—12 in FIG. 9.

A plurality of circumferentially spaced apart projections 38 extend outwardly from the outer surface of body member 12 adjacent to the proximal end portion 22. As best seen in FIG. 10, an internal alignment flange 40, is located at the proximal end portion 22.

Referring to FIGS. 9–12, inner core member 14 has a proximal end portion 42 and a distal end portion 44. Distal end portion is frusto-conical in shape and defines a cavity 46 formed therein. Core member 14 includes a pair of elongated, intersecting partition portions 47 that are substantially perpendicular to each other. Partition portions 47 extend from the distal end portion 44 to the proximal end portion 42. A plurality of longitudinally spaced apart rib portions 48 project transversely from the longitudinal center line of the core member. The partition portions 47 extend a short distance beyond the outer edges of the rib portions 48. The rib portions are substantially rectangular in cross-section and the exposed corners thereof are beveled at 50. The spacing between immediately adjacent rib portions adjacent the proximal end of the core member is preferably reduced in the area in facing relationship with the squeezable portion 28.

A section 52 of one of the partition portions 47 is cut-out at a proximal portion thereof so as to cooperate with the alignment flange 40 to orient the inner core member when it is inserted in the body member. A section 54 of one of the partition portions 47 is formed with a concave cross-section to cooperate with the first section 30 of squeezable portion 28.

A seal ring portion 56 is formed adjacent the distal end portion of the inner core member for sealing contact with an inner surface of the body member. As best seen in FIG. 10, cavity 46 extends distally beyond seal ring portion 56. A plurality of openings 58 are formed through the partition portions 46 of the core member 14 to permit radial fluid communication between the body portion 12 and the cavity 46 therethrough. The openings 48 are located proximally of the seal ring portion 56.

The body member 12 is preferably made from a relatively soft or flexible plastic material, such as low density polyethylene, having a nominal wall thickness of about 0.06 inches. The inner core member 14 is preferably formed from a substantially rigid plastic material, such as high density polyethylene or polypropylene.

Inner core member 14 is positioned within body member 12 such that the alignment flange 40 is received by cut-out section 52. In so doing, section 54 of the inner core member is in transverse alignment with first section 30. The distal end portion 44 of the inner core member extends distally beyond the distal end of the body member 12 with the seal ring portion 56 in transverse alignment with the male portion 26. Fibrous tip member 16 is received within cavity 46 with the distal end thereof extending beyond the distal end of inner core member 14.

Figure 9:
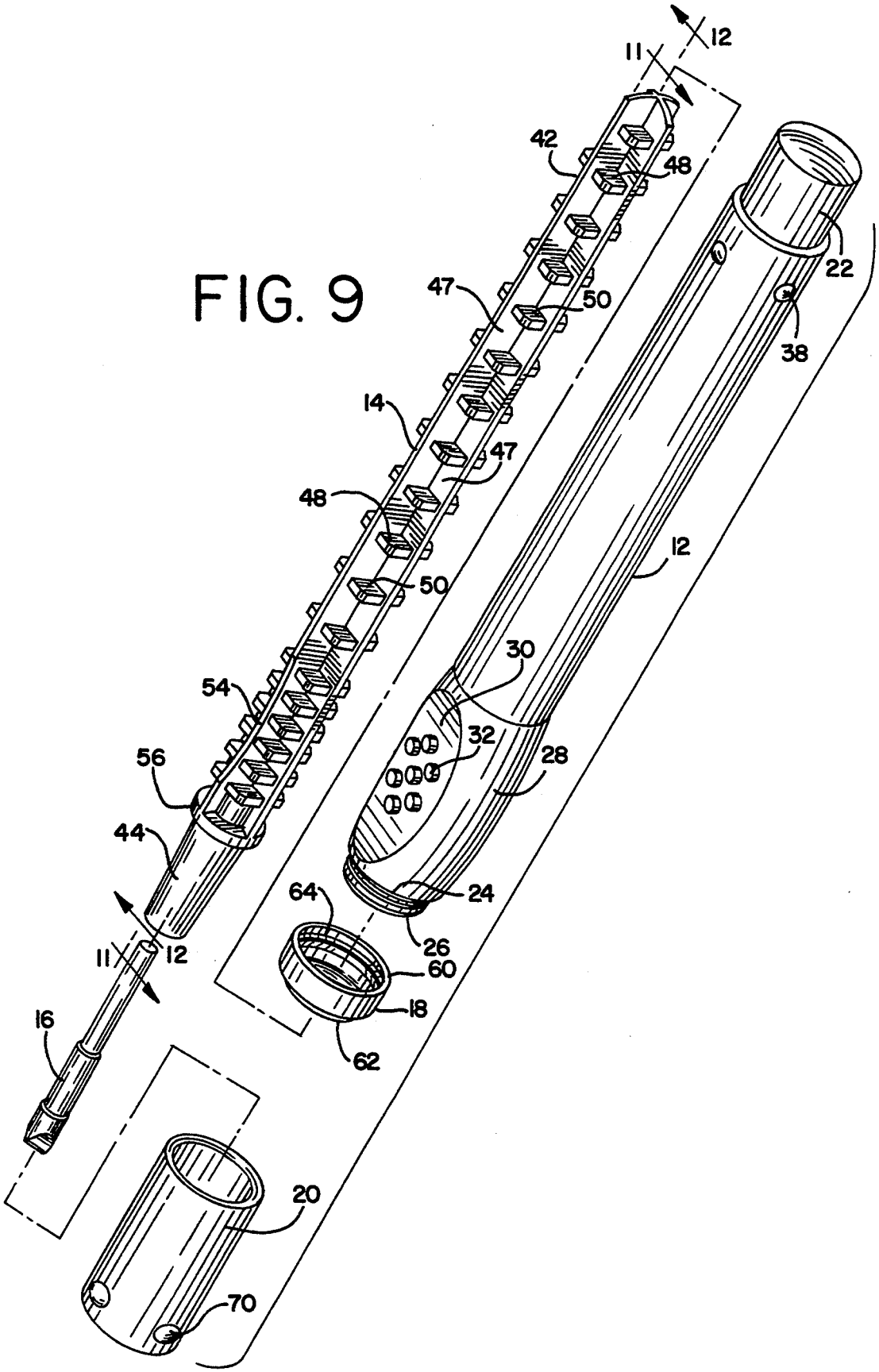
FIG. 9 is an exploded perspective view of the glue applicator as shown in FIG. 7.

Referring to FIGS. 9 and 10, ferrule member 18 has a proximal end portion 60 and a distal end portion 62. Proximal end portion 60 is provided with a female portion 64 of a snap fit assembly that receives the male portion 26 of body member 12. As the ferrule member 18 is tightened against the distal end of the body portion, the seal ring portion 56 is urged into sealing engagement with the inner surface of the body portion. The distal end portion 44 of the inner core member 14 extends through an opening 66 formed through the distal end portion 62.

Referring to FIG. 10, cap member 20 includes a cylindrical chamber 80 formed therein that receives and sealingly engages the outer surface of the distal end portion 44 of the inner core member 14. The cap member 20 is dimensioned to be frictionally received by the outer surface of the proximal end portion 22 of the body member 12. Cap member 20 may be provided with a plurality of circumferentially spaced projections 70. Projections 38 and 70 prevent the application from rolling off a substantially horizontal surface.

The body member 12 contains a suitable liquid glue or solvent bonder material of the type typically used for the assembly of polystyrene plastic members.

In operation, the liquid glue or bonder material with body member 12 flows through opening 58 to maintain a constant supply thereof to the fibrous tip 16. During use, when it is necessary to instantly and selectively increase the rate of glue flow at the tip, the first section 30 is depressed the index finger causing an instantaneous surge of fluid flow into the cavity 46 and through the tip 16. The rigid inner core member 14 provides structural support for the soft body member 12 while permitting the flow of fluid from the body member to the fibrous tip 16.

Although a particular embodiment of the invention is disclosed herein, it is not intended to limit the invention to such a disclosure and changes and modifications may be incorporated and embodied within the scope of the following claims.

What is claimed is:

1. A glue applicator for continuously, storing and applying liquid glue, comprising:

(a) an elongated generally cylindrical body member having a closed proximal end portion and an open distal end portion, said body member having a squeezable portion located adjacent the distal end portion thereof that may be deflected inwardly by a force applied by a finger;

(b) a substantially rigid elongated inner core member positioned within said body member and extending along substantially the entire length thereof, said inner core member having portions thereof that are in contact with an inner surface of said body member along substantially the entire length thereof, said inner core member having a distal end portion and a proximal end portion, said distal end portion of said inner core member having an elongated cavity formed therein that extends distally beyond the distal end portion of said body member;

(c) a fibrous tip member having a proximal end portion that is received within said cavity and a distal end portion that extends distally beyond the distal end portion of said inner core member;

(d) liquid glue contained with said body member, said inner core member having a plurality of openings formed therein for permitting the passage of said liquid glue from said body member therethrough into said cavity so as to contact said fibrous tip member; and (e) means for sealing the distal end of said body member to preclude liquid glue from escaping from said body member other than through said cavity.

2. The glue applicator as described in claim 1 wherein said squeezable portion is generally elliptical in transverse cross-section.

3. The glue applicator as described in claim 2 wherein a first section of said squeezable portion is concave in longitudinal cross-section.

4. The glue applicator as described in claim 3 wherein a second section of said squeezable portion is convex in longitudinal cross-section.

5. The glue applicator as described in claim 4 wherein said first section is diametrically opposed to said second section.

6. The glue applicator as defined in claim 3 wherein said first section has a plurality of spaced apart projections extending outwardly therefrom.

7. The glue applicator as defined in claim 4 wherein said second section has a plurality of spaced apart cavities formed therein.

8. The glue applicator as defined in claim 1 wherein said body member has a plurality of circumferentially spaced apart projections extending outwardly therefrom.

9. The glue applicator as defined in claim 1 wherein said body member has a longitudinal center line and said inner core member includes a plurality of longitudinally spaced apart rib portions that project transversely from the longitudinal center line of said body member toward an inner surface of said body member.

10. The glue applicator as defined in claim 9 wherein said inner core member includes a pair of intersecting partition portions that are substantially perpendicular to each other and said rib portions extend between adjacent intersecting sections thereof.

11. The glue applicator as defined in claim 10 wherein said partition portions extend a short distance beyond the outer edges of said rib portions.

12. The glue applicator as defined in claim 10 wherein said rib portions are substantially rectangular in cross-section and the exposed corners thereof are beveled.

13. The glue applicator as defined in claim 1 wherein said distal end portion of said inner core member is frusto-conical in shape and said cavity is formed therein.

14. The glue applicator as defined in claim 1 wherein a seal ring portion is formed adjacent said distal end portion of said inner core member for sealing contact with an inner surface of said body member.

15. The glue applicator as defined in claim 14 wherein said means for sealing the distal end of said body member includes a ferrule member having a female portion of a snap fit assembly that receives a male portion of a snap fit assembly formed on an external surface of said open distal end portion of said body member.

16. The glue applicator as defined in claim 15 wherein said inner core member has a seal ring portion formed adjacent said distal end portion thereof such that as said female portion of said ferrule member is received by said male portion of said body member said ring portion is urged into sealing contact with an inner surface of said body member.

17. The glue applicator as defined in claim 15 wherein said distal end portion of said inner core member extends distally through an opening formed in said ferrule member.

18. The glue applicator as defined in claim 14 wherein said openings formed in said inner core member are located proximally of said seal ring portion.

* * * * *